US005084303A

United States Patent [19]

Avera

[11] Patent Number: 5,084,303

[45] Date of Patent: Jan. 28, 1992

[54] METHOD FOR PRODUCING FAUX FINISHES ON NON-POROUS SURFACES

[76] Inventor: Ronald T. Avera, 706 Mockingbird, Pasadena, Tex. 77502

[21] Appl. No.: 546,032

[22] Filed: Jun. 28, 1990

Related U.S. Application Data

[63] Continuation-in-part of Ser. No. 217,562, Jul. 11, 1988, Pat. No. 4,946,715.

[51] Int. Cl.[5] ..... B05D 5/00; B05D 1/36

[52] U.S. Cl. ..... 427/263; 427/264; 427/265

[58] Field of Search ..... 427/262–268, 427/257

[56] References Cited

U.S. PATENT DOCUMENTS

| | | | |
|---|---|---|---|
| 835,213 | 11/1906 | Bösken | 427/263 |
| 1,410,344 | 3/1922 | Ornstein | 427/264 X |
| 1,413,429 | 4/1922 | Robson | 427/262 |
| 2,610,578 | 9/1952 | Paasche | 118/314 X |
| 3,202,527 | 8/1965 | Stevens | 427/263 X |
| 3,293,063 | 12/1966 | Pohl et al. | 427/263 |
| 3,382,089 | 5/1968 | Klein et al. | 427/262 |
| 3,493,418 | 2/1970 | Amano | 427/262 |
| 4,378,387 | 3/1983 | Mitchell | 427/263 |
| 4,508,763 | 4/1985 | Shemenski | 427/262 |

OTHER PUBLICATIONS

Burrell, H., "A Survey of Novelty Finishes", *Organic Finishing*, Dec., 1955, pp. 17–19.

*Primary Examiner*—Evan Lawrence

*Attorney, Agent, or Firm*—Pravel, Gambrell, Hewitt, Kimball & Krieger

[57] ABSTRACT

A method is described for producing a faux finish on a substrate having a non-porous surface, such as metal, by applying a coating of wet paint to the surface of the substrate moving at a substantially constant rate, immediately non-uniformly spattering the surface wit a mixture of paint solvent and protective coating, such as lacquer and lacquer thinner, and inducing the wet paint to flow randomly on the surface before drying, thereby creating a faux finish protected by the coating.

20 Claims, No Drawings

METHOD FOR PRODUCING FAUX FINISHES ON NON-POROUS SURFACES

This application is a continuation-in-part of application Ser. No. 217,562, filed July 11, 1988, now U.S. Patent No. 4,946,715.

FIELD OF THE INVENTION

This invention relates to a method for producing a product having a faux finish. More particularly, it relates to a method for producing a faux finish on a non-porous surface, such as metal molding used in framing pictures.

BACKGROUND OF THE INVENTION

In the art of picture framing, solid color metal molding has been used for many years, and it is associated with low cost framing that is not regarded in the industry as aesthetically pleasing. No one has ever produced metal molding having a pattern, let alone a faux finish, because the labor required to produce such finishes would make the product prohibitively expensive.

The art of creating faux finishes, such as marble, has been practiced for centuries. There are essentially two methods known for the production of faux finishes, namely, the positive and negative methods. These methods are described in Isabel O'Neil's *The Art of the Painted Finish for Furniture & Decoration* (1971). The term "positive" describes those processes in which the marble pattern is created by direct application of the paints to the surface to be decorated. Positive methods include flooding the surface with a base color and applying other colors in a pattern to the wet base-colored surface. Another positive method includes laying the floating colors on a dry surface and inducing them to flow with a spattering of mineral spirits.

O'Neil also describes the negative method which involves the creation of a marble-like pattern by the partial removal of paint. This method involves a surface which has been shellacked. The surface is coated with flatting oil and coated again with Japan paint thinned with flatting oil and mineral spirits. The marble finish is actually created by laying newspaper over the piece to absorb the colors.

Other references that describe faux finishes include Jocasta Innes' *Paint Magic* (rev'd. ed. 1987) which teaches a positive method of applying a faux marble finish to woodwork and floors by adding colors to a prepared surface.

Mitchell, in U.S. Pat. No. 4,378,387, discloses a method for superimposing marble patterns one upon the other on a flat surface, such as a paper surface. Briefly, the method entails floating and combining several colors of ink to create an ink film upon a surface of a liquid with which the ink is not miscible and contacting the paper surface with this ink film.

Shemenski, in U.S. Pat. No. 4,508,736, discloses a method for producing a pattern (not necessarily marble-like) upon a cylindrical, non-porous body such as a pen. The method includes spraying a first coat of lacquer onto the object, curing this coat, and then rolling the object along a textured patterning pad which applies a second coat. A hard, resinous, protective coating may be applied over the dried second coat.

Both O'Neil and Innes describe methods of producing a faux marble finish on surfaces that are absorbent (porous), such as wooden furniture and floors. Also, both describe methods that use only simple tools, such as brushes, paper, feathers and are thus labor-intensive. Mitchell is similarly directed toward a manual method of coating flat sheets such as paper. Shemenski, while applying a coat to a non-porous surface, is limited to cylindrical surfaces, such as pens, which can roll over the patterning pad for the application of the second coat. Significantly, in Shemenski's method, the object is physically rolled over a patterning pad which applies a second coat of paint. From the examples, it is readily apparent that Shemenski's method is also manual and labor-intensive.

In the manufacture of metal molding, the substrate is typically line fed through a spray painting machine, and a uniform coat of paint is applied. The line speed of this operation, which is usually over 200 feet per minute, does not permit the use of these known methods of creating faux finishes. There exists a need for an inexpensive, non-labor intensive method of applying a faux finish to a non-porous surface, such as a metal molding suitable for use in picture framing, which can be rapidly applied to keep pace with commercial production.

SUMMARY OF THE INVENTION

The present invention describes an automated, inexpensive method of creating a faux finish, such as marble, onto a non-porous substrate, such as metal molding and simultaneously protecting that finish with a lacquer overcoat. In its preferred embodiment, the invention includes the use of a spray painting machine which is equipped with at least two spray nozzles. The first spray nozzle applies a thin coating of paint, such as an oil-based paint, onto a continuously fed substrate. The second spray nozzle is immediately downstream and is adapted to apply a non-uniform coating or spattering of a mixture of paint solvent and protective coating. Of course, the paint solvent used must be compatible with the paint and the protective coating. For example, a mixture of lacquer and lacquer thinner will work well on all types of non-aqueous based paints. For this reason, lacquer and lacquer thinner is the preferred mixture of paint solvent and protective coating. Spattering this mixture causes the wet paint to vary in viscosity. The wet paint is induced to flow randomly by gravity or other means and produces a faux pattern which dries to a faux finish. The protective coating which was applied to the substrate by the second spray nozzle provides protection for the faux finish against scratching or chipping. It is also possible to use a water-based paint on the substrate. In this mode, a water-based lacquer mixed with water will function as the solvent and protective coating.

DESCRIPTION OF THE PREFERRED EMBODIMENTS

The method of this invention produces a faux finish, such as marble, on a substrate that has a non-porous surface. In order to practice this method, the substrate, e.g., metal molding, is fed through a coating machine where it is coated with paint. Immediately after the paint is applied to the surface of the substrate, it is spattered with a mixture of paint solvent and protective coating. Obviously, the solvent for the paint must be compatible with the protective coating so that the solvent and protective coating can be applied in a single step.

The solvent acts to decrease the viscosity of the wet paint, and the paint is induced to flow randomly by gravity or other means, such as blown air. The protective coating functions to protect the dried faux finish from scratching or chipping. The preferred embodiment uses non-aqueous based paints, and the preferred mixture for non-aqueous based paints is lacquer and lacquer thinner. However, aqueous based paints could also be used to practice this method. For aqueous based paints, the protective coating and solvent would be a mixture of water-based lacquer and water. This method is not preferred primarily because an aqueous system usually takes longer to dry. This invention will be discussed in terms of the preferred embodiment, but it is understood that those skilled in the art could devise other systems once this concept is known.

Spattering the mixture of lacquer and lacquer thinner in a non-uniform manner causes the paint coating to vary in viscosity. This variance in viscosity of the wet paint permits the paint to flow unevenly, creating a faux pattern that dries into a faux finish. After the substrate is dried, the lacquer acts to protect the faux finish from scratching or chipping.

Several factors will affect the faux finish. One of these factors is the line speed of the substrate. In order to create a product having a consistent faux finish, the line speed should be maintained at a fairly constant rate while preparing a particular lot. In addition, the rate of application and type of paint used will affect the faux finish. Furthermore, the ratio of lacquer to lacquer thinner in the mixture will affect the finish. Therefore, it may be necessary to adjust these variables to achieve an aesthetically pleasing product.

Another factor that will affect the faux finish is the drying time. Since the paint flow is a function of time, the drying step should be closely controlled to provide for a consistent faux finish. One way to control the drying step would be to maintain a fixed temperature and humidity. Of course, drying ovens can be used to accelerate the drying step, if desired. One skilled in the art will be able to easily determine the appropriate drying time for a particular paint and mixture of lacquer and lacquer thinner. Another way to control the drying step is to change the volume of paint and spattering mixture being applied to the surface. It has been discovered that the drying time can be reduced to a matter of seconds simply by manipulating the application rate and ratio of the paint and spattering mixture.

As previously stated, the mixture of lacquer and lacquer thinner which is spattered on the wet painted substrate alters the viscosity of the paint and allows the paint to flow in a random pattern. Care should be taken not to apply an excessive amount of paint solvent because the wet paint could flow completely off the substrate. One skilled in the art will be able to readily determine the rate, volume and ratio of the mixture to apply to the painted substrate.

The actual flow of the wet paint may be induced by any appropriate means, e.g., gravity or blown air. For instance, in the preferred embodiment, a curved metal substrate would be coated with paint and immediately spattered with the mixture of lacquer and lacquer thinner. The finished substrate would be removed from the apparatus and allowed to air dry or heat could be applied to speed the drying time. The force of the spattering mixture and the effect of gravity during the drying step would cause the wet paint to flow randomly on the curved surface, creating a faux pattern which dries to a faux finish. After the surface of the substrate is dried, the lacquer from the mixture acts to protect the faux finish from scratching or chipping.

The preferred method of this invention employs a machine equipped with (1) a means for feeding a length of the substrate to be decorated, (2) at least one spray nozzle adapted to apply a coating of paint on the substrate, and (3) at least one spray nozzle immediately downstream from the paint spray nozzle adapted to apply a non-uniform coat of a mixture of lacquer and lacquer thinner onto the wet painted substrate, i.e., spatter the mixture onto the substrate.

The mixture of lacquer and lacquer thinner can vary in a ratio of from about 2 to 1 to about 1 to 2. The preferred mixture is a 1 to 1 ratio of lacquer to lacquer thinner. Increasing the ratio of lacquer in the mixture causes the faux finish to be slightly textured. Increasing the ratio of lacquer thinner in the mixture decreases the thickness of the protective lacquer coating but increases the flow characteristics of the wet paint.

An automatic molding sprayer that can be adapted to perform this method is commercially available. For example, American Machine Corp. in Van Nuys, Calif. offers a model LSP-2600-M which has two spray nozzles. This machine is designed to apply spray paint to a substrate through both nozzles, but it can be altered to apply paint through the first nozzle and a non-uniform mixture of lacquer and lacquer thinner through the second nozzle. Normally, the air to paint pressure ratio in a paint spray system is about 40 psi air to 5 psi liquid. This ratio may vary according to the manufacturer's design. The effect of this pressure ratio is to atomize the paint so as to apply a fairly uniform coating.

In the mixture spray system, the pressure ratio is adjusted to cause the mixture of lacquer and lacquer thinner to spatter so as to apply a non-uniform coat of the mixture. The air to mixture pressure ratio in this spray system may vary from about 3–10 psi air to 20–80 psi mixture. The preferred air to mixture pressure ratio of this spray system is about 7 psi air to 40 psi mixture. The mixture is applied immediately after the painting step. In most circumstances, the mixture is spattered onto the wet painted surface within about 10 seconds after the paint is applied, preferably within about 1 second.

The rate of feed for the substrate may also be adjusted in conjunction with the rate of application of paint and spattering mixture to vary the faux finish. The typical line speed of model LSP-2600-M from American Machine Corporation is 220 feet per minute. The type of paint employed in this method is any type of non-aqueous paint compatible with the mixture of solvent and protective coating and suitable for application onto a non-porous substrate.

Of course, the manner in which the paint is applied is not critical since the paint will be induced to flow. Therefore, it is possible to practice this method by rolling or brushing the paint onto the substrate, although these methods are not preferred. Likewise, any manner of applying a spattering of lacquer and lacquer thinner should provide the same effect.

In the most preferred embodiment, a prepainted metal molding is used as the substrate. This prepainted substrate is not affected by the method of this invention, but the color of the prepainted substrate forms the base color of the faux finish. For example, a red-colored metal molding can be used as the substrate, and white paint can be applied by the method of this invention. The spattered lacquer and lacquer thinner will cause the white paint to run unevenly across the surface of the red-colored substrate. The finished product will have a red base color with streaks of white forming the faux finish. Obviously, the color of the substrate and the color of the paint used in this method affect the color of the faux finish, and an infinite variety of faux finishes are possible.

The principal of the invention and the best mode contemplated for applying that principle have been described. It is to be understood that the foregoing is illustrative only and that other means and techniques can be employed without departing from the true scope of the invention defined in the following claims.

What is claimed is:

1. An automated method for producing a faux finish on a substrate having a non-porous surface, comprising the steps of:

feeding said substrate at a substantially constant rate through a coating apparatus;

coating said surface with at least one paint to provide a wet painted surface;

spattering onto said wet painted surface a non-uniform coating comprising a mixture of protective coating and solvent for said paint;

inducing at least some of the wet paint on said surface to flow randomly thereby creating a faux pattern; and drying said paint and protective coating on said surface to create a protected faux finish.

2. The method of claim 1, wherein said protective coating is lacquer.

3. The method of claim 2, wherein said solvent is lacquer thinner.

4. The method of claim 3, wherein said mixture of lacquer and lacquer thinner is spattered onto said wet painted surface by means of air pressure.

5. The method of claim 4, wherein the air to mixture pressure ratio is from about 3–10 psi air to about 20–80 psi mixture.

6. The method of claim 5, wherein said air to mixture pressure ratio is about 7 psi air to about 40 psi mixture.

7. The method of claim 3, wherein the mixture of lacquer and lacquer thinner varies from about 2 parts lacquer to 1 part thinner to about 1 part lacquer to 2 parts thinner.

8. The method of claim 7, wherein the mixture of lacquer and lacquer thinner is about 1 part lacquer to about 1 part thinner.

9. The method of claim 1, wherein said paint is sprayed onto said surface.

10. The method of claim 1, wherein said non-porous surface is a prepainted substrate.

11. An automated method for producing a faux finish on metal molding comprising the steps of:

feeding said molding at a substantially constant rate through a coating apparatus;

coating said molding with at least one paint to provide a wet painted surface;

spattering onto said wet painted surface a non-uniform coating comprising a mixture of lacquer and lacquer thinner, said lacquer thinner being a solvent for said paint and said mixture varying from about 2 parts lacquer to 1 part thinner to about 1 part lacquer to 2 parts thinner;

inducing at least some of the wet paint on said surface to flow randomly thereby creating a faux pattern; and drying said paint and lacquer on said surface to form said faux finish protected by lacquer.

12. The method of claim 11, wherein said paint is sprayed onto said surface.

13. The method of claim 11, wherein said mixture is spattered onto said wet painted surface by means of air pressure.

14. The method of claim 13, wherein the air to mixture pressure ratio is from about 3–10 psi air to about 20–80 psi mixture.

15. The method of claim 14, wherein said air to mixture pressure ratio is about 7 psi air to about 40 psi mixture.

16. The method of claim 11, wherein said metal molding is prepainted with a base paint.

17. The method of claim 11, wherein the mixture of lacquer and lacquer thinner is about 1 part lacquer to about 1 part thinner.

18. A method for producing a faux finish on a metal molding, comprising the steps of:

feeding said molding at a substantially constant rate through an apparatus which has at least two in-line spray nozzles;

coating said molding at a first nozzle with at least one paint to provide a wet painted surface;

spattering onto said wet painted surface at a second nozzle a non-uniform coating comprising a mixture of lacquer and lacquer thinner, said lacquer thinner being a solvent for said paint;

inducing at least some of the wet paint on said surface to flow randomly thereby forming a faux pattern; and drying said paint and lacquer on said surface to create a faux finish protected by lacquer.

19. The method of claim 18, wherein said metal molding is prepainted with a base paint.

20. The method of claim 18, wherein the mixture of lacquer and lacquer thinner varies from about 2 parts lacquer to 1 part thinner to about 1 part lacquer to 2 parts thinner.

* * * * *